US007243375B2

(12) United States Patent
Seo

(10) Patent No.: US 7,243,375 B2
(45) Date of Patent: Jul. 17, 2007

(54) PROTECTION GEAR AGAINST HARMFUL INSECTS

(76) Inventor: Jung Eun Seo, 11-704 Hyundai Apt. 56, Myoungil-dong, Kangdong-gu, Seoul (KR) 134-072

( * ) Notice: Subject to any disclaimer, the term of this patent is extended or adjusted under 35 U.S.C. 154(b) by 0 days.

(21) Appl. No.: 10/527,029

(22) PCT Filed: Sep. 5, 2003

(86) PCT No.: PCT/KR03/01830

§ 371 (c)(1),
(2), (4) Date: Aug. 10, 2005

(87) PCT Pub. No.: WO2004/021814

PCT Pub. Date: Mar. 18, 2004

(65) Prior Publication Data

US 2006/0048258 A1 Mar. 9, 2006

(30) Foreign Application Priority Data

Sep. 6, 2002 (KR) ..... 10-2002-0053805

(51) Int. Cl.
*A41D 13/00* (2006.01)
*A41D 13/02* (2006.01)

(52) U.S. Cl. ..... 2/69; 2/4; 2/79

(58) Field of Classification Search ..... 2/4, 2/69, 59, 171, 227, 29, 202, 206, 195.5, 200.1, 2/158, 159, 161.1, 167
See application file for complete search history.

(56) References Cited

U.S. PATENT DOCUMENTS

| | | | | |
|---|---|---|---|---|
| 2,344,811 | A * | 3/1944 | Gill | 2/4 |
| 3,808,339 | A * | 4/1974 | Bordenca | 514/659 |
| 4,422,184 | A * | 12/1983 | Myers | 2/4 |
| 4,424,642 | A * | 1/1984 | Stubler et al. | 43/114 |
| 5,091,993 | A | 3/1992 | Merrill | |
| 5,214,797 | A * | 6/1993 | Tisdale | 2/455 |
| 5,249,307 | A | 10/1993 | Lemoine | |

(Continued)

FOREIGN PATENT DOCUMENTS

CA 2 316469 1/2002

(Continued)

*Primary Examiner*—Gloria M. Hale
(74) *Attorney, Agent, or Firm*—Volpe and Koenig, P.C.

(57) ABSTRACT

Provided is protection gear against harmful insects that enables controlling and capturing of harmful insects in addition to protection against harmful insects. The protection gear against harmful insects includes a protection net made of ventilative cloth, woven fabric, or nonwoven fabric, the protection net being worn to cover the head, trunk, arms, hands, legs, and feet of the human body; and a fastener for fastening the protection net to the human body. Since the protection net is coated with an insecticide and/or a repellent, the effect of and insecticide and/or repellent lasts. Also, good durability is ensured since a washing is not required. Even if the sizes of ventilation holes of the protection net are larger than harmful insects, harmful insects can be dissuaded from settling on it. Furthermore, due to comfortable wearability, it can be used as a substitute for pajamas outdoors. Still furthermore, since the adhesive net is inexpensive and disposable, the protection gear against harmful insects can capture harmful insects, while maintaining a lasting insecticide and/or repellent effect.

2 Claims, 3 Drawing Sheets

U.S. PATENT DOCUMENTS

| | | | | |
|---|---|---|---|---|
| 5,249,310 | A | 10/1993 | Forte | |
| 5,341,511 | A * | 8/1994 | Wells | 2/456 |
| 5,717,990 | A * | 2/1998 | Alquist et al. | 2/4 |
| 6,326,015 | B1 * | 12/2001 | Tucci et al. | 424/403 |

FOREIGN PATENT DOCUMENTS

| | | | |
|---|---|---|---|
| JP | 10-96108 | A | 4/1998 |
| KR | 20-0264328 | Y1 | 2/2002 |

* cited by examiner

PROTECTION GEAR AGAINST HARMFUL INSECTS

FIELD OF THE INVENTION

The present invention relates to protection gear against harmful insects, and more particularly, to protection gear against harmful insects that enables controlling and capturing of harmful insects in addition to protection against harmful insects.

BACKGROUND

Generally, many efforts and attempts, such as the use of a mosquito net or an insecticide, have been made to protect human bodies from harmful insects, such as mosquitoes and flies.

In particular, persons who are mainly outdoors for work or who summer in the open air are likely to be harmed by harmful insects, such as mosquitoes, that transmit fatal infectious diseases and induce skin itching.

Conventionally, an insecticide spray is used for controlling flies, mosquitoes, and ticks. In particular, for outdoors activities, an insecticide or a repellent, a substance that gives off an offensive odor to dissuade mosquitoes or ticks from settling on human bodies, is applied on clothes or human bodies.

However, there are great inconveniences in using such an insecticide or repellent as follows: the effect of an insecticide or repellent is not continuous, contact with the skin may cause skin troubles, thereby adversely affecting user's health, and spraying or rubbing completely over human bodies is practically impossible.

SUMMARY OF THE INVENTION

The present invention provides protection gear against harmful insects. Due to the use of a protection net coated with an insecticide and/or a repellent, an insecticide and/or repellent effect lasts. Also, good durability is ensured since a washing is not required. Even if the sizes of the ventilation holes in the protection net are larger than harmful insects, the harmful insects are dissuaded from settling on it. In addition, due to comfortable wearability, it can be used as a substitute for pajamas outdoors.

The present invention also provides protection gear against harmful insects which can capture harmful insects, while maintaining a lasting excellent insecticide or repellent effect, due to the use of an inexpensive, disposable adhesive net.

According to an aspect of the present invention, there is provided protection gear against harmful insects comprising: a protection net made of ventilative cloth, woven fabric, or nonwoven fabric, the protection net being worn to cover the head, trunk, arms, hands, legs, and feet of the human body; and a fastener for fastening the protection net to the human body.

The protection net may comprise an insecticide cap for covering the head, an insecticide mask for covering the face, an insecticide upper garment for covering the trunk, insecticide sleeves for covering the arms, wristlets, insecticide gloves for covering the hands, insecticide trousers for covering the legs, insecticide anklets for covering the ankles, and insecticide shoes, socks, or stockings for covering the feet or shoes. The protection net may be made in the form of mosquito net clothes, clothes of ramie cloth, clothes of hemp cloth, shoulder strap, waistcoat, overskirt with slits, belt, or wrist strap. The fastener may be a string, an elastic band, a button, or a velcro tape.

The protection net may be comprised of a frame made of a flexible elastic band having an elasticity sufficient to be separated from the human body by a predetermined distance; and an adhesive net adhered to the frame, the adhesive net being made into a close net form sufficient for ventilation and prevention of the invasion of harmful insects including flies, mosquitoes, ants, ticks, and fleas, and being treated with an insecticide and/or a repellent. The adhesive net may be a disposable adhesive net having one adhesive surface so that while it adheres to a base paper, it adheres to the frame after being removed from the base paper when used.

A surface of yarn or cloth for the protection net may be coated with an insecticide and/or a repellent using a binder to be used for a long time without being washed, for example, when a military serviceman wears the protection net over his uniform.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Hereinafter, protection gear against harmful insects according to an embodiment of the present invention will be described in detail with reference to the accompanying drawings.

Figure 1:
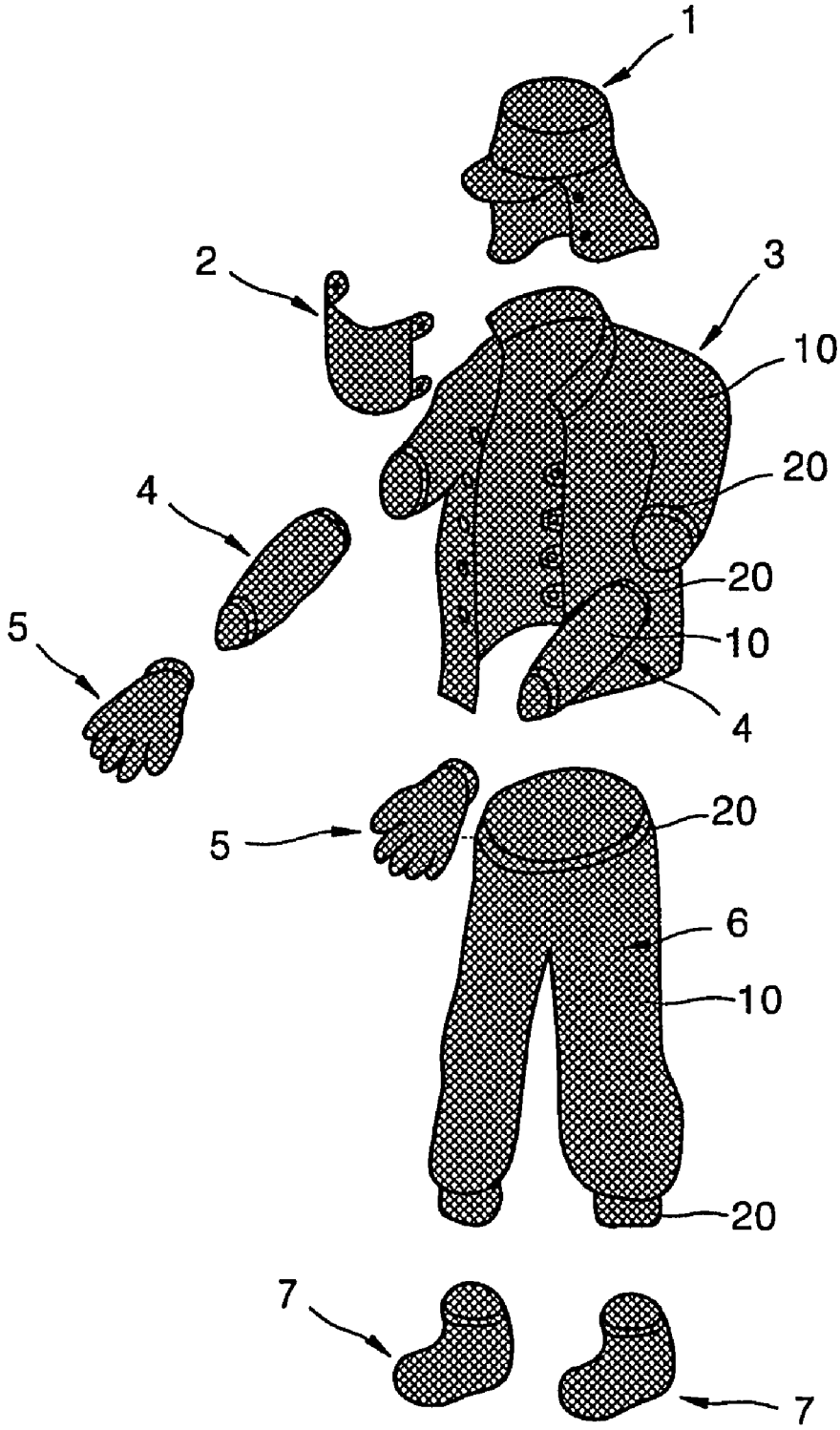
FIG. 1 is a perspective view of protection gear against harmful insects according to an embodiment of the present invention.

First, referring to FIG. 1, protection gear against harmful insects according to an embodiment of the present invention is largely comprised of a protection net 10 and a fastener 20.

In detail, the protection net 10 is worn to cover the head, trunk, arms, hands, legs, and feet of the human body and is made of ventilative cloth, woven fabric, or nonwoven fabric. The protection net 10 comprises an insecticide cap 1 for covering the head, an insecticide mask 2 for covering the face, an insecticide upper garment 3 for covering the trunk, insecticide sleeves 4 for covering the arms, insecticide gloves 5 for covering the hands, insecticide trousers 6 for covering the legs, and insecticide shoes, socks sheeks, or stockings 7 for covering the feet or shoes.

Although not shown in the drawings, the protection net 10 may be made in the form of a mantle with a cap, wristlets, insecticide anklets for covering the ankles, a shoulder strap, a waistcoat, an overskirt with slits, belt, or a wrist strap.

In addition, the protection net 10 may be made of mosquito net cloth, ramie cloth, hemp cloth, cut cloth, or nonwoven fabric. The protection net 10 may also be made in a partial band form.

The fastener 20 is used to fasten the protection net 10 to the human body. The fastener 20 may be a string, an elastic band, a button, or a velcro tape. An elastic band capable of making an end of the protection net 10 narrow and then fastening it to the human body is preferable, as shown in FIG. 1.

In particular, a surface of yarn or cloth for the protection net 10 is coated with an insecticide and/or a repellent using a binder. An insecticide and/or a repellent may be coated on both surfaces or one surface of yarn or cloth for the protection net 10. In this case, it is preferable to use an insecticide and/or a repellent harmless to the human body. An insecticide or a repellent may be coated directly or may be coated after encapsulated.

An insecticide for killing harmful insects and a repellent giving off an offensive odor are widely disclosed in related art and commercially available, and thus, the detailed description thereof will be omitted herein. Various conventional types of binders can be used for coating an insecticide and/or a repellent on the protection net 10. Therefore, various modifications or changes in an insecticide, a repellent, and a binder that can be used herein may be made by those of ordinary skill in the art without departing from the spirit and scope of the present invention.

When a user wears the protection net 10, an insecticide and/or repellent coated on the protection net 10 can dissuade mosquitoes from settling on the user's body. The effect of an insecticide and/or repellent can last longer since the protection net 10 does not need to be washed.

Therefore, in a case where a field worker or a military serviceman wears the protection net 10 over his uniform, the protection net 10 can be used for an extended period of time without being washed.

Even if the sizes of the ventilation holes in the protection net 10 are larger than mosquitoes, mosquitoes are dissuaded from settling on the protection net 10 due to an insecticide and/or a repellent coated on the protection net 10. Also, the protection net 10 has comfortable wearability due to such large ventilation holes. Therefore, the protection net 10 allows adults or babies to sleep or live comfortable in a room and outdoors.

Figure 2:
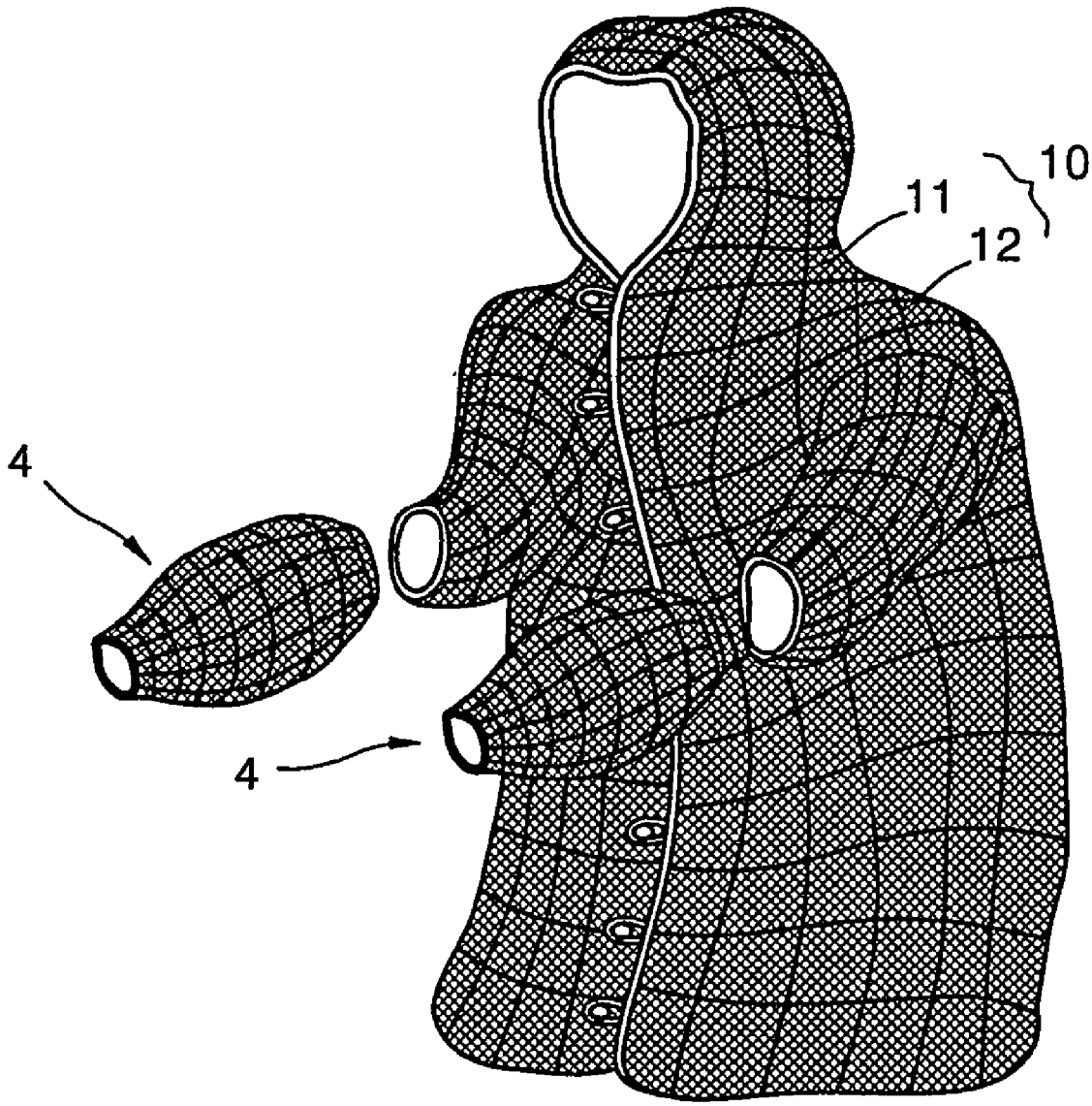
FIG. 2 is a perspective view of protection gear against harmful insects according to another embodiment of the present invention.
Figure 3:
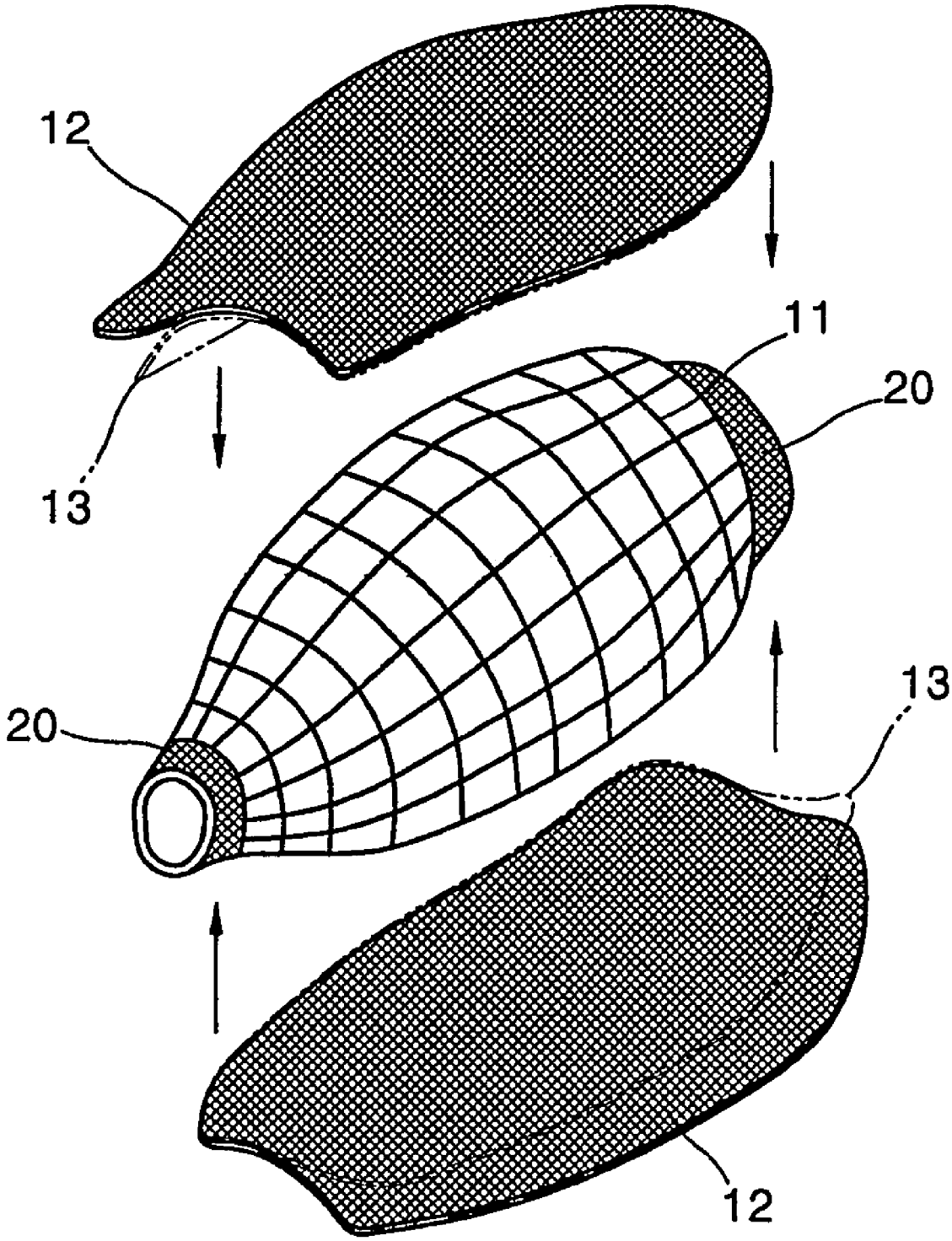
FIG. 3 is a detailed exploded perspective view of an insecticide sleeve shown in FIG. 2.

Meanwhile, referring to FIGS. 2 and 3, the protection net 10 is comprised of a frame 11 made of a flexible elastic band having elasticity sufficient to be separated from the human body by a predetermined distance; and an adhesive net 12 adhered to the frame 11, the adhesive net 12 being made into a close net form sufficient for ventilation and prevention of the invasion of harmful insects, such as flies, mosquitoes, ants, ticks, and fleas.

In detail, as shown in FIG. 3, the adhesive net 12 may be a disposable adhesive net having one adhesive surface so that while it adheres to a base paper 13, it adheres to the frame 11 after being removed from the base paper 13 when used.

On the other hand, the other surface of the adhesive net 12 that is exposed is sticky so that harmful insects can be captured. The sticky surface of the adhesive net 12 may contain an attractant and/or an insecticide and/or a repellent.

Therefore, a user can protect his body from mosquitoes by removing the adhesive net 12 from the base paper 13 and then adhering the adhesive net 12 to the frame 11 to cover the frame 11, as shown in FIG. 3. Even if the human body is not completely covered by the adhesive net 12, an insecticide and/or repellent contained in the adhesive net 12 can dissuade mosquitoes from settling on the human body. Further, mosquitoes settled on the human body by an attractant can be captured on the sticky surface of the adhesive net 12.

Since the adhesive net 12 is inexpensive and disposable, the protection net 10 can lastingly maintain the effect of an insecticide and/or repellent.

The present invention is not limited to the above exemplary embodiments thereof. Therefore, those of ordinary skill in the art may make various changes without departing from the spirit and scope of the present invention.

For example, although the above embodiments of the present invention are explained with regard to mosquitoes, various other harmful insects such as ants, bees, and flies can be controlled, combatted, or captured. Also, protection gear against harmful insects of the present invention can be applied to a combat uniform worn by a military serviceman for a plain battle, a military uniform such as a guard uniform worn by a guard, and clothes worn by a person living outdoors.

The scope of the present invention is not limited to the above detailed description, but is defined by the following claims.

As apparent from the above description, the present invention provides protection gear against harmful insects. Due to the use of a protection net coated with an insecticide and/or repellent, the effect of an insecticide and/or repellent lasts. Also, good durability is ensured since washing is not required. Even if the sizes of the ventilation holes in the protection net are larger than harmful insects, the harmful insects are dissuaded from settling on it. Furthermore, due to comfortable wearability, it can be used as a substitute for pajamas outdoors. Still furthermore, the protection gear against harmful insects can capture harmful insects, while maintaining a lasting insecticide and/or repellent effect, due to the use of an inexpensive, disposable adhesive net.

What is claimed is:

1. Protection gear against harmful insects comprising:

a protection net made of ventilative cloth to cover at least one of a face, a head, a trunk, arms, hands, legs, and feet of a human body, the protection net being coated with at least one of an insecticide and an insect repellent using a binder;

a fastener for fastening the protection net to the human body;

an elastic frame configured to separate the protection net from the human body by a predetermined distance, wherein one surface of the protection net is adhesive so that the protection net can be attached to the elastic frame; and a base paper adhered to the adhesive surface of the protection net such that the protection net can be attached to the elastic frame after removing the base paper from the protection net.

2. The protection gear against harmful insects according to claim 1, wherein the other surface of the protection net is sticky so that harmful insects can be captured.

* * * * *